US011088458B2

(12) United States Patent
Jafargholi et al.

(10) Patent No.: US 11,088,458 B2
(45) Date of Patent: Aug. 10, 2021

(54) REDUCING MUTUAL COUPLING AND BACK-LOBE RADIATION OF A MICROSTRIP ANTENNA

(71) Applicants: Amir Jafargholi, Tehran (IR); Ali Jafargholi, Tehran (IR); Mehdi Veysi, Irvine, CA (US); Jun H. Choi, Buffalo, NY (US)

(72) Inventors: Amir Jafargholi, Tehran (IR); Ali Jafargholi, Tehran (IR); Mehdi Veysi, Irvine, CA (US); Jun H. Choi, Buffalo, NY (US)

(73) Assignees: Amir Jafargholi, Tehran (IR); AMIRKABIR UNIVERSITY OF TECHNOLOGY, Tehran (IR)

( * ) Notice: Subject to any disclaimer, the term of this patent is extended or adjusted under 35 U.S.C. 154(b) by 143 days.

(21) Appl. No.: 16/236,592

(22) Filed: Dec. 30, 2018

(65) Prior Publication Data

US 2019/0140348 A1 May 9, 2019

Related U.S. Application Data

(60) Provisional application No. 62/612,448, filed on Dec. 31, 2017.

(51) Int. Cl.
*H01Q 15/00* (2006.01)
*H01Q 9/04* (2006.01)

(52) U.S. Cl.
CPC ..... *H01Q 15/0086* (2013.01); *H01Q 9/0457* (2013.01)

(58) Field of Classification Search
CPC ..... H01Q 9/0407–0478; H01Q 15/006–0086; H01Q 1/245; H01Q 1/42; H01Q 1/422; H01Q 1/425; H01Q 1/52; H01Q 1/521; H01Q 1/523; H01Q 1/525; H01Q 1/526
See application file for complete search history.

(56) References Cited

U.S. PATENT DOCUMENTS 6,946,995 B2 9/2005 Choi et al.
7,889,137 B2 * 2/2011 Wu ..... H01Q 9/0421 343/700 MS
8,193,996 B2 * 6/2012 Wu ..... H01Q 1/42 343/872
8,350,759 B2 1/2013 Ju et al.

OTHER PUBLICATIONS

Attia et al. "Enhanced-gain microstrip antenna using engineered magnetic superstrates." IEEE Antennas and Wireless Propagation Letters 8, No. 1 (2009): 1198-1201.

(Continued)

*Primary Examiner* — Dimary S Lopez Cruz
*Assistant Examiner* — Patrick R Holecek
(74) *Attorney, Agent, or Firm* — Bajwa IP law Firm; Haris Zaheer Bajwa

(57) ABSTRACT

A microstrip antenna is disclosed. The microstrip antenna includes a dielectric substrate with a first relative permittivity, a metal patch, and a magneto-dielectric superstrate. The metal patch is printed on the dielectric substrate, and the magneto-dielectric superstrate is placed above the metal patch.

20 Claims, 28 Drawing Sheets

100

(56) References Cited

OTHER PUBLICATIONS

Jackson et al. "Gain enhancement methods for printed circuit antennas." IEEE transactions on antennas and propagation 33, No. 9 (1985): 976-987.
Syed et al. "Front-to-back ratio enhancement of planar printed antennas by means of artificial dielectric layers." IEEE Transactions on Antennas and Propagation 61, No. 11 (2013): 5408-5416.
Attia et al. "Theoretical and experimental investigation of patch antennas loaded with engineered magnetic superstrates." In Wireless Technology Conference (EuWIT), 2010 European, pp. 97-100. IEEE, 2010.
Majid et al. "Microstrip antenna's gain enhancement using left-handed metamaterial structure." Progress in Electromagnetics Research 8 (2009): 235-247.

* cited by examiner

REDUCING MUTUAL COUPLING AND BACK-LOBE RADIATION OF A MICROSTRIP ANTENNA

CROSS-REFERENCE TO RELATED APPLICATION

This application claims the benefit of priority from U.S. Provisional Patent Application Ser. No. 62/612,448, filed on Dec. 31, 2017, and entitled "MICROSTRIP PATCH AND ARRAY WITH METAMATERIAL SUPERSTRATE," which is incorporated herein by reference in its entirety.

TECHNICAL FIELD

The present disclosure generally relates to radio wireless communication systems, and particularly, to antennas and array antennas.

BACKGROUND

One of the problems associated with finite ground plane patch antennas is back-lobe radiation, which occurs as a direct consequence of surface wave diffraction at the edges of the ground plane. The back-lobe level of the antennas increases specific absorption rate (SAR) for mobile users, interference level from external source noise, and power loss; which in turn reduce the signal-to-noise ratio in wireless communication systems.

Another problem associated with large antenna systems, such as phased array and reflect-array antennas, is mutual coupling between antenna elements. The strong mutual coupling between antenna elements may reduce the array efficiency, cause the scan blindness in phased array systems, limit the practical packing density of arrays, and degrade the performance of diversity antennas and multiple input multiple output (MIMO) communication systems. Undesired generation of surface waves in a substrate is a source of the mutual coupling between the array elements.

To counter such problems, techniques have been proposed to improve antenna isolation. Some of such techniques include defected ground structure (DGS), a simple ground plane modification, complementary meander line slots, parallel coupled-line resonators, polarization conversion isolator, and incorporating electromagnetic band gap (EBG) structures. However, insertion of at least two rows of EBG structures between array elements is required to provide moderate isolation between the antennas. Also, the EBG structures must be placed at a specified distance away from an antenna edge to obtain an acceptable return loss. Moreover, insertion of EBG increases an inter-element spacing to be larger than $0.5\lambda_0$, resulting in a larger array and limiting the scan angle for beam steering arrays. $\lambda_0$ is free-space wavelength.

There is, therefore, a need for a method for reducing back-lobe radiation and mutual coupling without increasing antenna size. There is also a need for a cost-effective antenna structure with a reduced back-lobe radiation.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure describes an exemplary method for reducing mutual coupling and back-lobe radiation of a microstrip antenna. The method may include printing a metal patch of a microstrip antenna on a dielectric substrate with a first relative permittivity, and placing a magneto-dielectric superstrate above the metal patch.

In an exemplary embodiment, placing the magneto-dielectric superstrate above the metal patch may include placing a plurality of parallel slabs with an effective relative permittivity and an effective relative permeability above the metal patch. Each of the plurality of parallel slabs may include a plurality of capacitively loaded loop metamaterial (CLL-MTM) units.

In an exemplary embodiment, an exemplary method may further include generating an electric field in the metal patch through a feed line. The electric field may be parallel with planes of the plurality of parallel slabs.

In an exemplary embodiment, placing the plurality of parallel slabs above the metal patch may include providing a space between two successive parallel slabs of the plurality of parallel slabs. In an exemplary embodiment, placing the plurality of parallel slabs above the metal patch may further include placing a plurality of equally-spaced parallel slabs above the metal patch. A length of each of the plurality of equally-spaced parallel slabs may be equal to or smaller than a length of the dielectric substrate.

In an exemplary embodiment, placing the magneto-dielectric superstrate above the metal patch may include placing the magneto-dielectric superstrate on an air gap above the metal patch. A height of the air gap may be smaller than ten percent of a wavelength associated with an operating frequency of the microstrip antenna.

In an exemplary embodiment, the present disclosure describes an exemplary microstrip antenna. An exemplary microstrip antenna may include a dielectric substrate with a first relative permittivity, a metal patch, and a magneto-dielectric superstrate. The metal patch may be printed on the dielectric substrate, and the magneto-dielectric superstrate may be placed above the metal patch.

In an exemplary embodiment, magneto-dielectric superstrate may include a plurality of parallel slabs. Each of the plurality of parallel slabs may include a plurality of capacitively loaded loop metamaterial (CLL-MTM) units.

In an exemplary embodiment, the microstrip antenna may further include a feed line configured to generate an electric field in the metal patch. The electric field may be parallel with planes of the plurality of parallel slabs.

In an exemplary embodiment, an exemplary microstrip antenna may further include a space between each two successive parallel slabs of the plurality of parallel slabs. In an exemplary embodiment, the plurality of parallel slabs may include a plurality of equally-spaced parallel slabs. A length of each of the plurality of equally-spaced parallel slabs may be equal to or smaller than a length of the dielectric substrate.

In an exemplary embodiment, the magneto-dielectric superstrate may be placed on an air gap above the metal patch. A height of the air gap may be smaller than ten percent of a wavelength associated with an operating frequency of the microstrip antenna.

Other exemplary systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the claims herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed an exemplary method for reducing back-lobe radiations and mutual coupling in microstrip antennas. The exemplary method reduces back-lobe radiation by loading a microstrip antenna with a magneto-dielectric superstrate metamaterial arrays that effectively simulate the magneto-dielectric superstrate. By adjusting the permittivity and permeability of the magneto-dielectric superstrate based on the physical properties of the microstrip antenna, back-lobe radiation may be significantly reduced. Consequently, mutual coupling of elements in an antenna array may also be reduced by utilizing microstrip antennas with reduced back-lobe radiations in the structure of the antenna array.

Figure 1A:
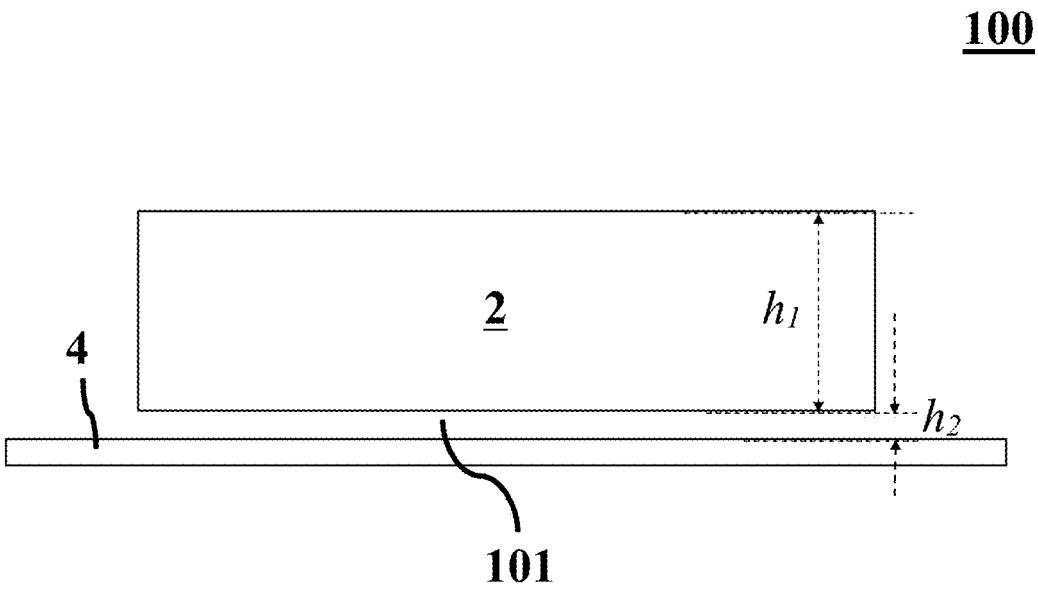
FIG. 1A shows a side-view of a schematic of an exemplary microstrip antenna, consistent with one or more exemplary embodiments of the present disclosure.
Figure 1B:
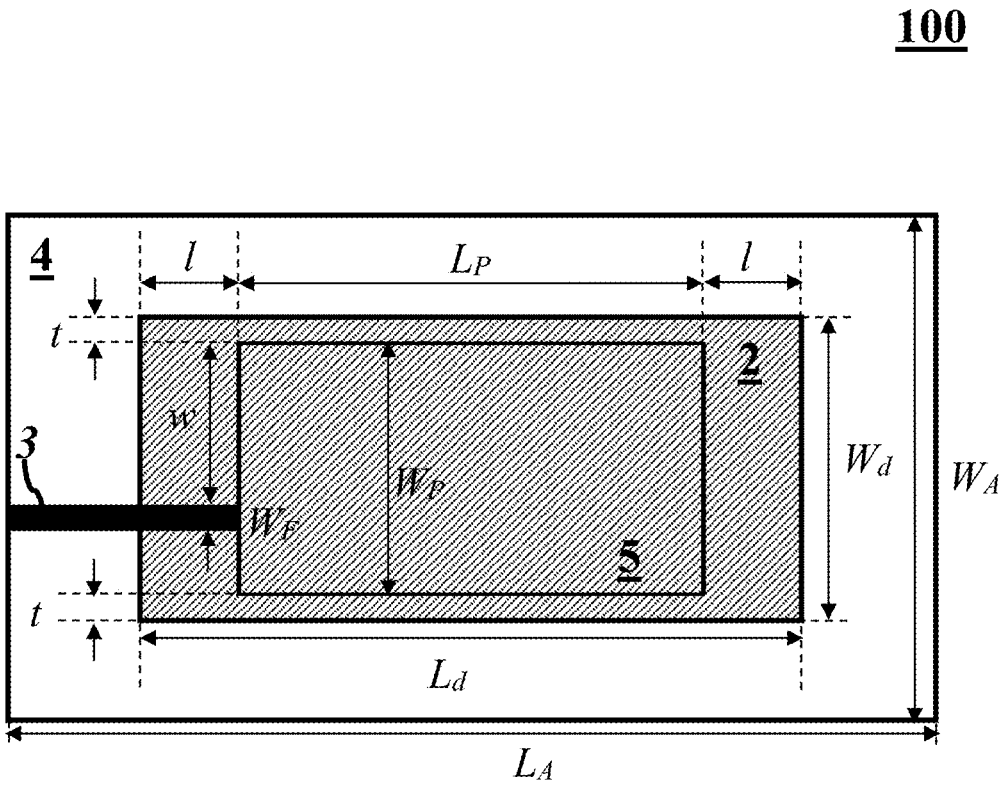
FIG. 1B shows a top-view of a schematic of an exemplary microstrip antenna, consistent with one or more exemplary embodiments of the present disclosure.

FIG. 1A shows a side-view of a schematic of an exemplary microstrip antenna, consistent with one or more exemplary embodiments of the present disclosure. FIG. 1B shows a top-view of a schematic of an exemplary microstrip antenna, consistent with one or more exemplary embodiments of the present disclosure. In an exemplary embodiment, an exemplary microstrip antenna 100 may include a dielectric substrate 4 with a first relative permittivity $\varepsilon_1$, a metal patch 5, and a magneto-dielectric superstrate 2. In an exemplary embodiment, metal patch 5 may be printed on dielectric substrate 4 and magneto-dielectric superstrate 2 may be placed above metal patch 5.

Figure 2:
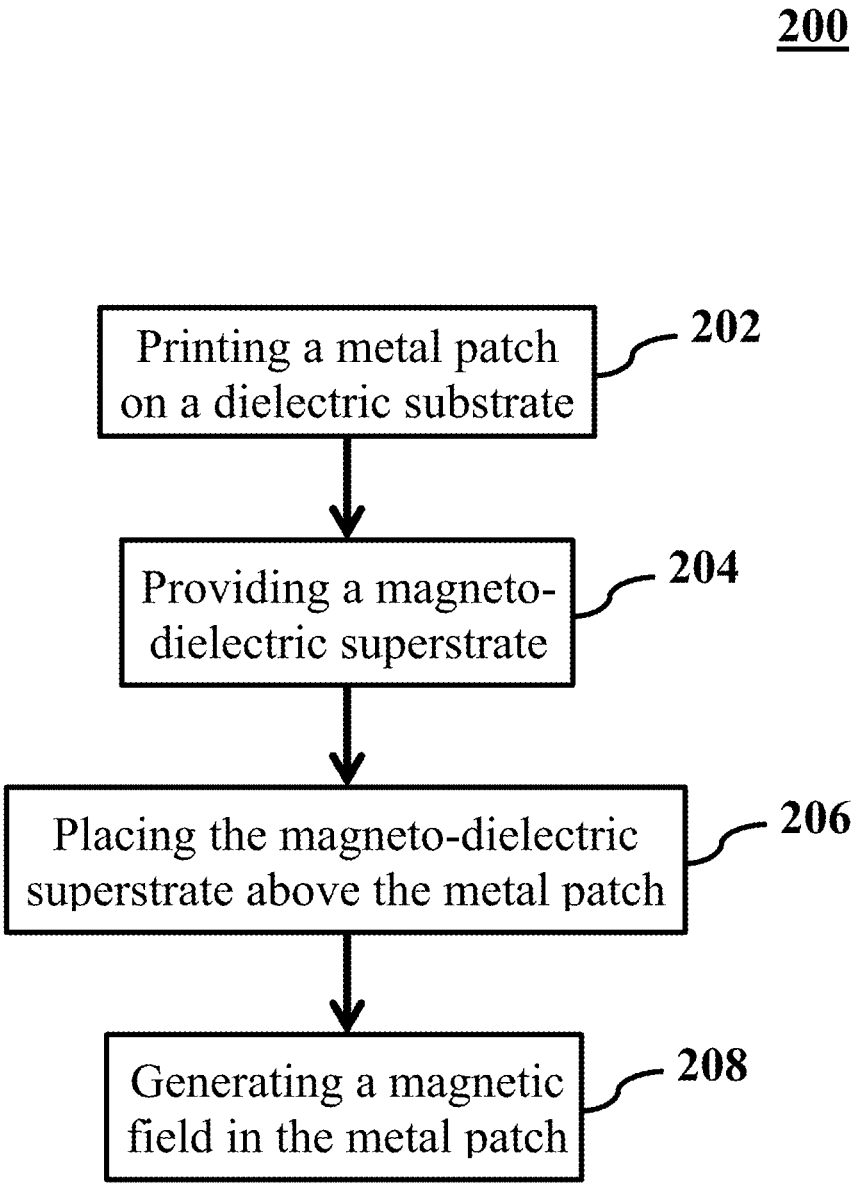
FIG. 2 shows a flowchart of an exemplary method for reducing mutual coupling and back-lobe radiation of a microstrip antenna, consistent with one or more exemplary embodiments of the present disclosure.

FIG. 2 shows a flowchart of an exemplary method 200 for manufacturing and reducing mutual coupling and back-lobe radiation of a microstrip antenna, consistent with one or more exemplary embodiments of the present disclosure. In an exemplary embodiment, method 200 may utilize microstrip antenna 100. In an exemplary embodiment, method 200 may include printing metal patch 5 on dielectric substrate 4 with the first relative permittivity $\varepsilon_1$ (step 202), providing magneto-dielectric superstrate 2 (step 204), and placing magneto-dielectric superstrate 2 above metal patch 5 (step 206).

In an exemplary embodiment, providing magneto-dielectric superstrate 2 (step 204) may include providing a superstrate with a second relative permittivity $\varepsilon_2$ and a relative permeability $\mu_2$. In an exemplary embodiment, providing magneto-dielectric superstrate 2 may include stimulating magneto-dielectric superstrate 2 by a properly engineered metamaterial. Second relative permittivity $\varepsilon_2$ and relative permeability $\mu_2$ may satisfy a condition, according to the following:

$$|\varepsilon_1-\varepsilon_2\cdot\mu_2|<\delta, \quad (1)$$

where $\delta$ is an upper threshold. Ideally, $\delta$ may be set to zero. However, due to practical considerations such as measurement errors, in an exemplary embodiment, upper threshold $\delta$ may be set to 0.5.

Figure 1C:
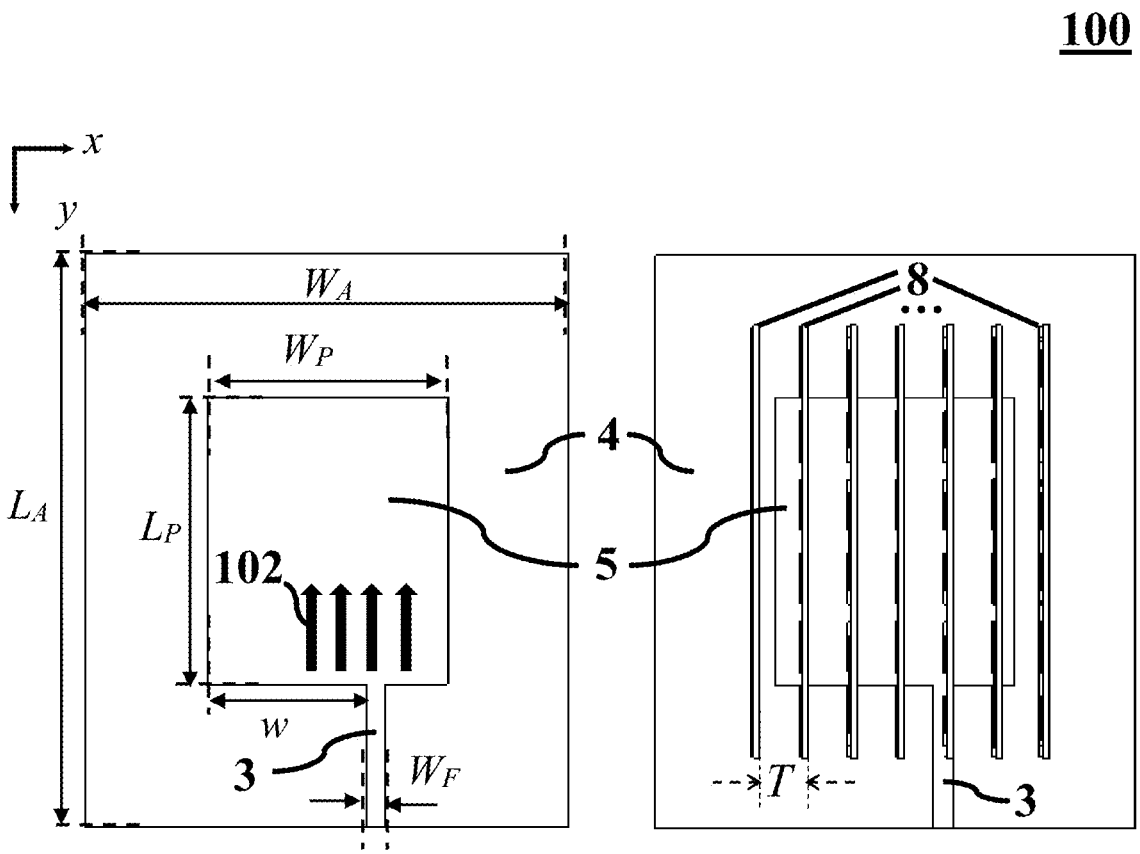
FIG. 1C shows a top-view of a schematic of a plurality of parallel slabs placed on an exemplary microstrip antenna, consistent with one or more exemplary embodiments of the present disclosure.
Figure 1D:
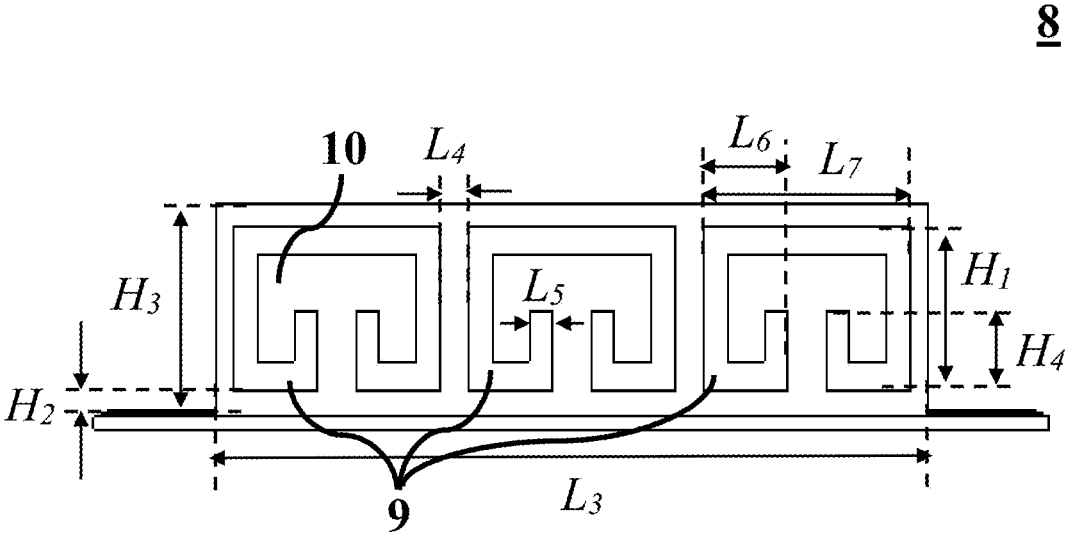
FIG. 1D shows a side-view of a schematic of a slab of a plurality of parallel slabs placed on an exemplary microstrip antenna, consistent with one or more exemplary embodiments of the present disclosure.

FIG. 1C shows a top-view of a schematic of a plurality of parallel slabs placed on an exemplary microstrip antenna, consistent with one or more exemplary embodiments of the present disclosure. FIG. 1D shows a side-view of a schematic of a slab of a plurality of parallel slabs placed on an exemplary microstrip antenna, consistent with one or more exemplary embodiments of the present disclosure. In an exemplary embodiment, magneto-dielectric superstrate 2 may include a plurality of parallel slabs 8. Each of plurality of parallel slabs 8 may include a plurality of capacitively loaded loop metamaterial (CLL-MTM) units 9.

Referring to FIGS. 1A-D and 2, in an exemplary embodiment, method 200 may further include generating an electric field 102 in metal patch 5 through a feed line 3 (step 208) that feeds an electric current into microstrip antenna 100. In an exemplary embodiment, electric field 102 may be parallel with planes of plurality of parallel slabs 8.

In an exemplary embodiment, providing plurality of parallel slabs 8 in step 206 may include providing a space T between two successive parallel slabs of plurality of parallel slabs 8. In an exemplary embodiment, space satisfying a condition according to $(N-1)\times T\leq W_A$, where N is the number of plurality of parallel slabs 8, T is the space, and $W_A$ is a width of dielectric substrate 4. In an exemplary embodiment, plurality of parallel slabs 8 may be equally spaced, and a length $L_3$ of each of the plurality of equally-spaced parallel slabs may be equal to or smaller than a length $L_A$ of the dielectric substrate.

In an exemplary embodiment, placing magneto-dielectric superstrate 2 above metal patch 5 (step 206) may further include placing magneto-dielectric superstrate 2 on an air gap 101 above metal patch 5. A height $h_2$ of air gap 101 may be smaller than about ten percent of a wavelength associated with an operating frequency of microstrip antenna 100. Since this value may be negligible, the total size of the antenna may be considerably reduced by this approach.

EXAMPLE

In this example, the effects of magneto-dielectric superstrate 2 relative permittivity/relative permeability on the performance of microstrip antenna 100 is numerically investigated. An exemplary antenna design parameters are tabulated in the Table 1. To avoid unwanted interaction between magneto-dielectric superstrate 2 and fringing (near) field of metal, air gap 101 may be added between them. However, the height of air gap 101 may be neglected as the dimension is considerably smaller than the operating wavelength. The antenna is matched to 50Ω through feed line 3.

TABLE 1

Approximate values of an antenna design parameters.

| Design Parameters | Value (mm) | Design Parameters | Value (mm) |
|---|---|---|---|
| $L_A$ | 80 | t | 3 |
| $W_A$ | 60 | l | 8.49 |
| $L_P$ | 40 | $h_1$ | 10.83 |
| $W_P$ | 30 | $h_2$ | 1.58 |
| $L_d$ | 56.98 | Substrate thickness | 0.762 |
| $W_d$ | 36 | | |
| $W_F$ | 2.4 | | |
| w | 19.8 | | |

Figure 3:
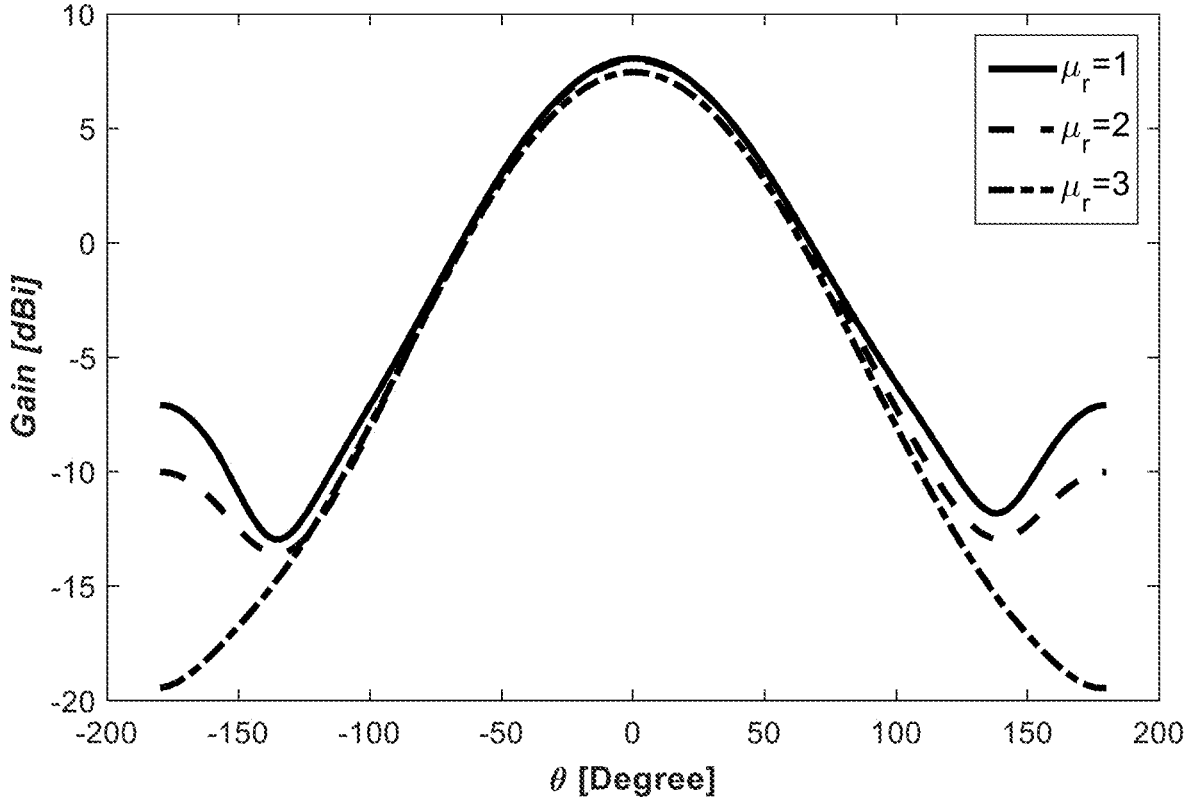
FIG. 3 shows an E-plane antenna gain with a superstrate layer of different relative permeability values, consistent with one or more exemplary embodiments of the present disclosure.

It is well-known that a microstrip patch antenna radiates mostly from the magnetic equivalent current at the aperture and the magnetic loading has no considerable effects on the radiating electric field. Therefore, to avoid unwanted disturbance in the antenna radiation while addressing surface wave suppression, magneto-dielectric superstrate 2 parameters are set as relative permittivity $\varepsilon_2 \approx 1$ and $\mu_2 \approx 3$ for numerical analysis, so that $\varepsilon_2 \cdot \mu_2 \approx 3$, and the condition of (1) is satisfied. FIG. 3 shows an E-plane antenna gain with a superstrate layer of different relative permeability values, consistent with one or more exemplary embodiments of the present disclosure. As can be seen, increasing the superstrate layer's relative permeability by factor of 2 reduces the back-lobe level by about 3 dB. This approach does not alter the boresight gain of microstrip antenna 100. For a relative permeability of three for magneto-dielectric superstrate 2, the back-lobe level drops by about 12 dB, but the gain decreases by about 0.5 dB. H-plane radiation patterns also follow the same behavior as the E-plane patterns.

Figure 4A:
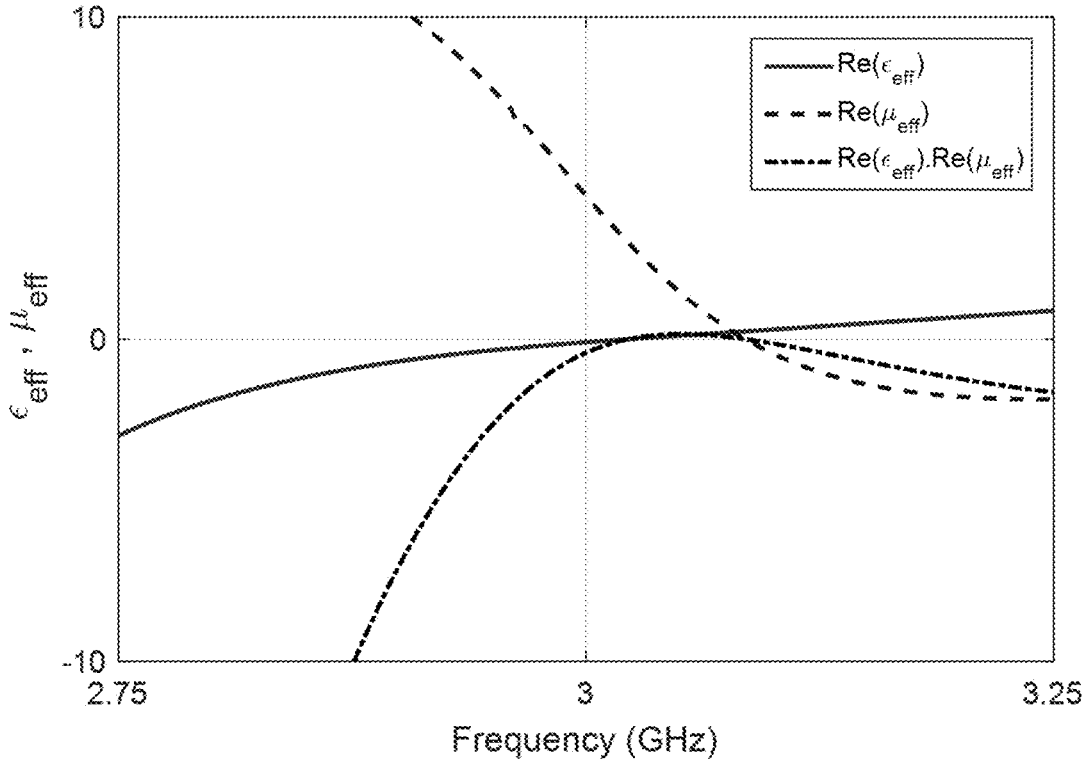
FIG. 4A shows variations of an effective relative permittivity ($\varepsilon_r$) and an effective relative permeability ($\mu_r$) of a CLL-MTM unit versus frequency, consistent with one or more exemplary embodiments of the present disclosure.

FIG. 4A shows variations of an effective relative permittivity ($\varepsilon_{eff}$) and an effective relative permeability ($\mu_{eff}$) of a CLL-MTM unit of plurality of CLL-MTM units 9 versus frequency, consistent with one or more exemplary embodiments of the present disclosure. An RT-Duroid 5880 is used as a dielectric material, the substrate thickness is set about 0.762 mm, and the dielectric constant is set to about 2.2. An exemplary CLL-MTM unit cell exhibits magneto-dielectric behavior in the frequency range below 3.2 GHz.

Figure 4B:
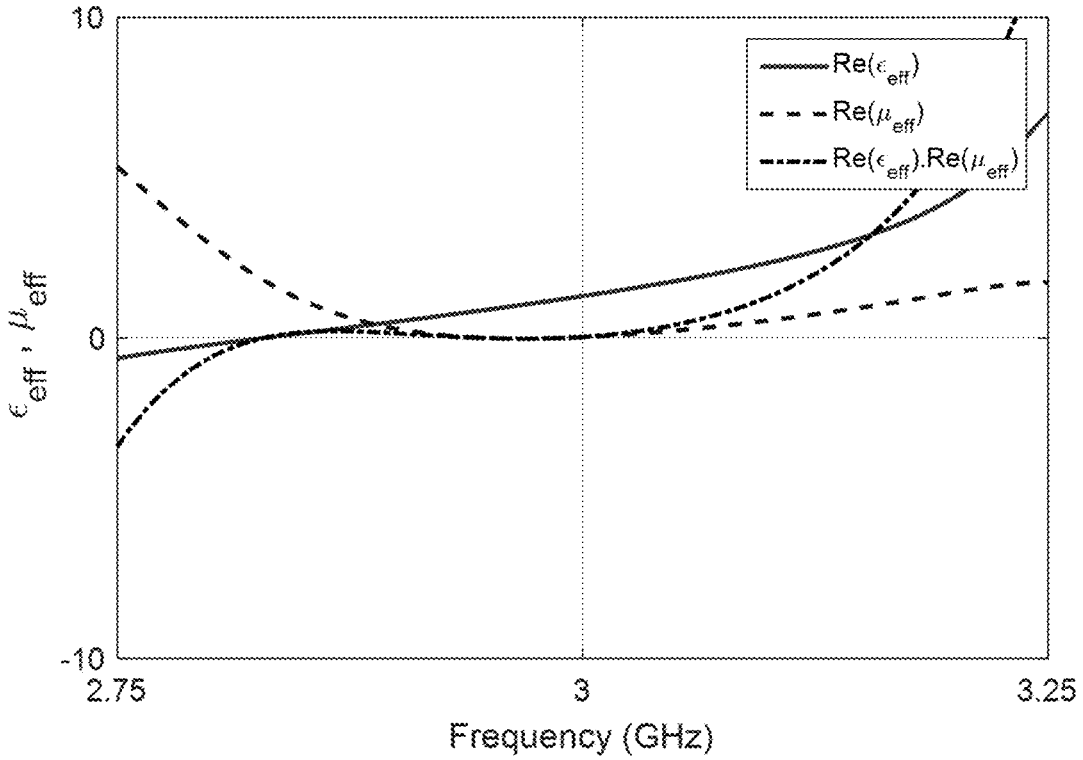
FIG. 4B shows variations of an effective relative permittivity ($\varepsilon_{eff}$) and an effective relative permeability ($\mu_{eff}$) of a slab versus frequency, consistent with one or more exemplary embodiments of the present disclosure.

FIG. 4B shows variations of an effective relative permittivity ($\varepsilon_{eff}$) and an effective relative permeability ($\mu_{eff}$) of a slab of plurality of parallel slabs 8 versus frequency, consistent with one or more exemplary embodiments of the present disclosure. In the resonant frequency region, the relative permittivity and relative permeability change as a function of a number of layers, which is due to electromagnetic coupling between the metamaterial unit-cells. The numerical results show the effective $\varepsilon_r \cdot \mu_r$ is approximately around 3 which is required for a microstrip antenna with a substrate relative permit of about $\varepsilon_r = 2.2$ operating in the frequency range from about 3.1 GHz to about 3.2 GHz. Moreover, the electric field polarization does not change effective response of the CLL-MTM unit.

Figure 5:
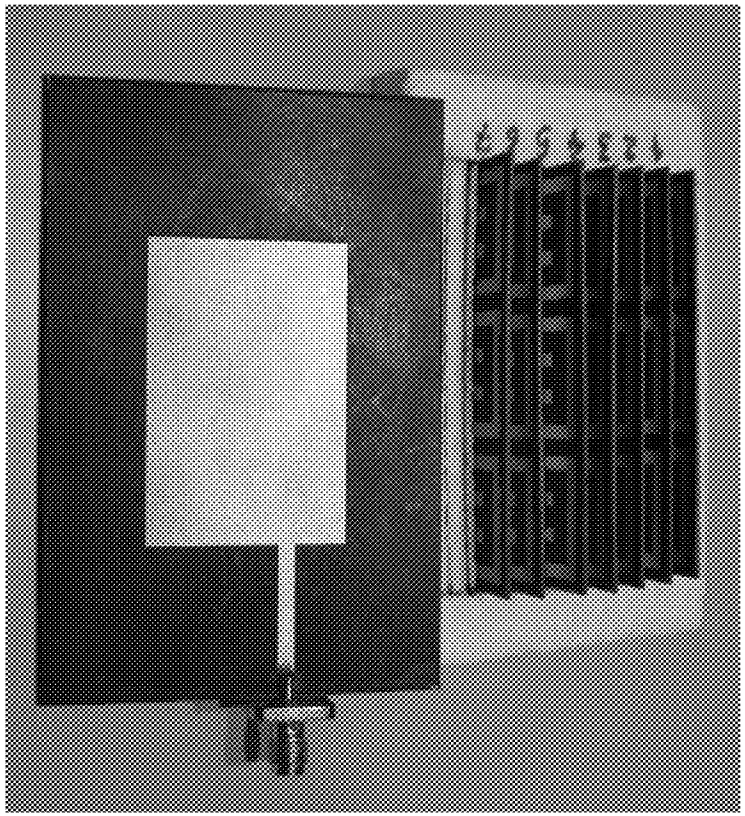
FIG. 5 shows a fabricated prototype of a microstrip antenna, consistent with one or more exemplary embodiments of the present disclosure.

The values of the CLL-MTM unit design parameters are provided in the Table 2. For a rectangular implementation of metal patch 5 with a size of $L_P \times W_P$, since $L_P > W_P > L_P/2$, the dominated mode is $TM_{100}$ and the electric field intensity beneath metal patch 5 varies as a cosine function the x-axis, and is a constant in the y-axis. To impose the maximum uniformity and due to the anisotropic response of the CLL-MTM unit structure, plurality of parallel slabs 8 are placed in a way that the electric field illuminates the cells uniformly. In an exemplary embodiment, placing plurality of parallel slabs 8 in the y-direction provides a uniform constant illumination. FIG. 5 shows a fabricated prototype of microstrip antenna 100, consistent with one or more exemplary embodiments of the present disclosure.

TABLE 2

Approximate values of a CLL-MTM loaded antenna design parameters.

| Design Parameters | Value (mm) | Design Parameters | Value (mm) |
|---|---|---|---|
| $L_A$ | 80 | $L_4$ | 2.5 |
| $W_A$ | 60 | $L_5$ | 1.95 |
| $L_P$ | 40 | $L_6$ | 7.04 |
| $W_P$ | 30 | $L_7$ | 17.33 |
| $W_F$ | 2.4 | $H_1$ | 10.83 |

TABLE 2-continued

Approximate values of a CLL-MTM loaded antenna design parameters.

| Design Parameters | Value (mm) | Design Parameters | Value (mm) |
|---|---|---|---|
| w | 19.8 | $H_2$ | 1.58 |
| T | 6 | $H_3$ | 13.9 |
| $L_3$ | 60 | $H_4$ | 5.3 |

Figure 6:
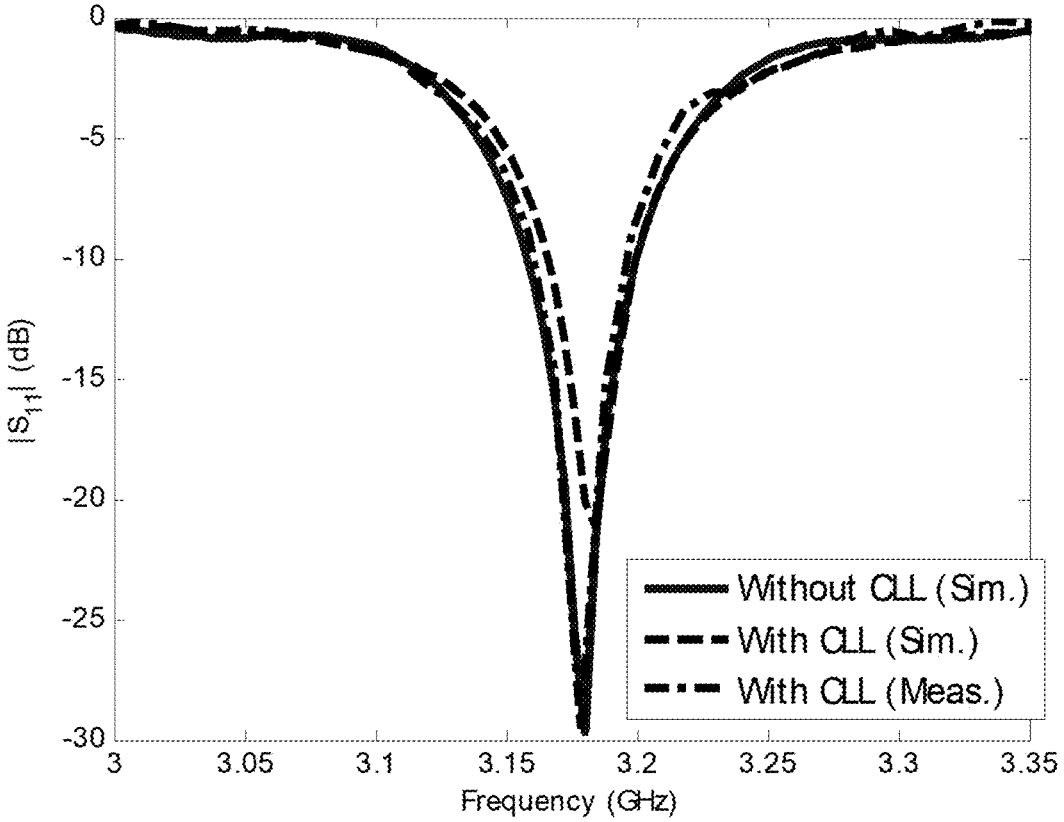
FIG. 6 shows a measured reflection coefficient of an exemplary microstrip antenna.

FIG. 6 shows a measured reflection coefficient of an implementation of microstrip antenna 100 as compared with the simulation results with and without the CLL-MTM superstrate. The antenna impedance bandwidth ($|S_{11}| < -10$ dB) of about 1.75% is observed from about 3.15 to about 3.2 GHz. The presence of the CLL-MTM superstrate does not introduce any significant effect on the input match of the antenna.

Figure 7A:
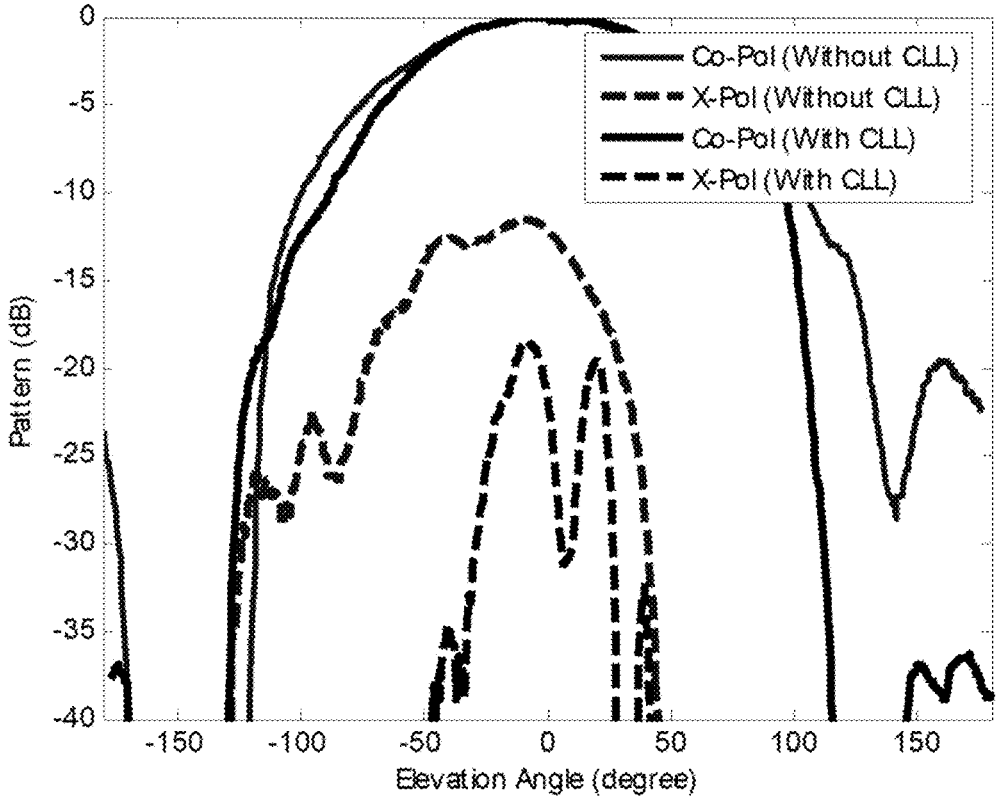
FIG. 7A shows normalized radiation patterns of an exemplary microstrip antenna with and without a CLL-based MTM superstrate plotted in an E-plane, consistent with one or more exemplary embodiments of the present disclosure.
Figure 7B:
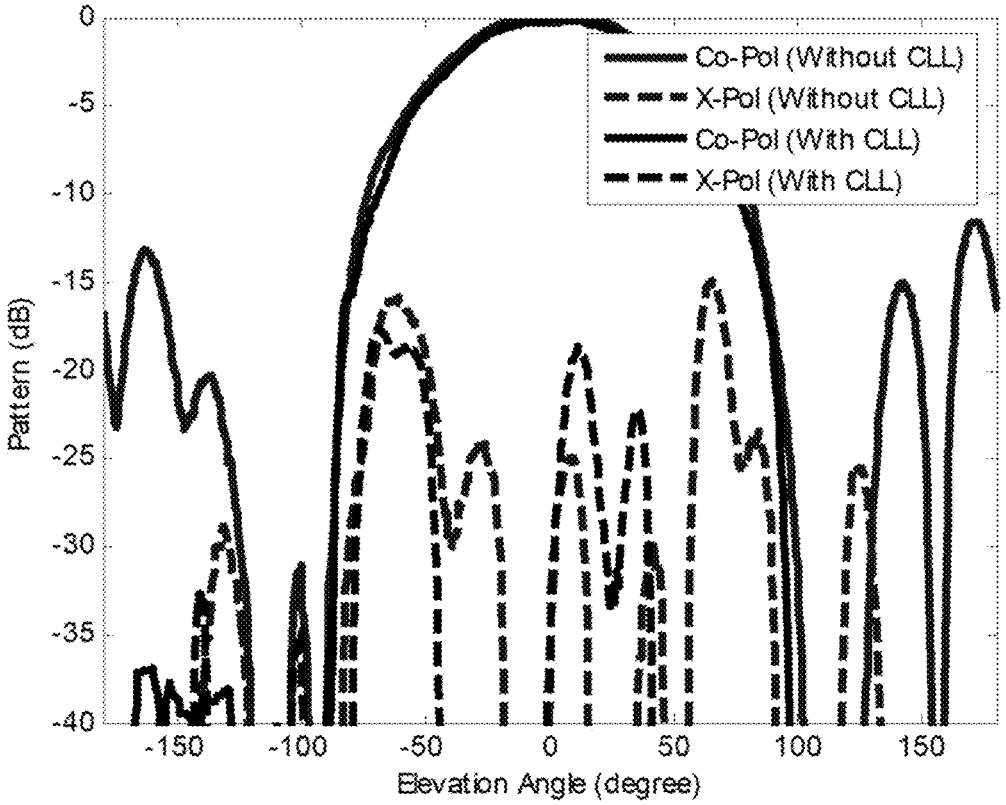
FIG. 7B shows normalized radiation patterns of an exemplary microstrip antenna with and without a CLL-based MTM superstrate plotted in an H-plane, consistent with one or more exemplary embodiments of the present disclosure.

FIG. 7A shows normalized radiation patterns of an exemplary implementation of microstrip antenna 100 with and without a CLL-based MTM superstrate plotted in an E-plane, consistent with one or more exemplary embodiments of the present disclosure. FIG. 7B shows normalized radiation patterns of an exemplary implementation of microstrip antenna 100 with and without a CLL-based MTM superstrate plotted in an H-plane, consistent with one or more exemplary embodiments of the present disclosure. As can be seen in FIGS. 7A and 7B, the presence of the CLL-based MTM superstrate maintains the main lobe characteristics. However, at the center frequency of about 3.18 GHz, at least an about 12 dB reduction is observed in the back-lobe level.

Figure 8A:
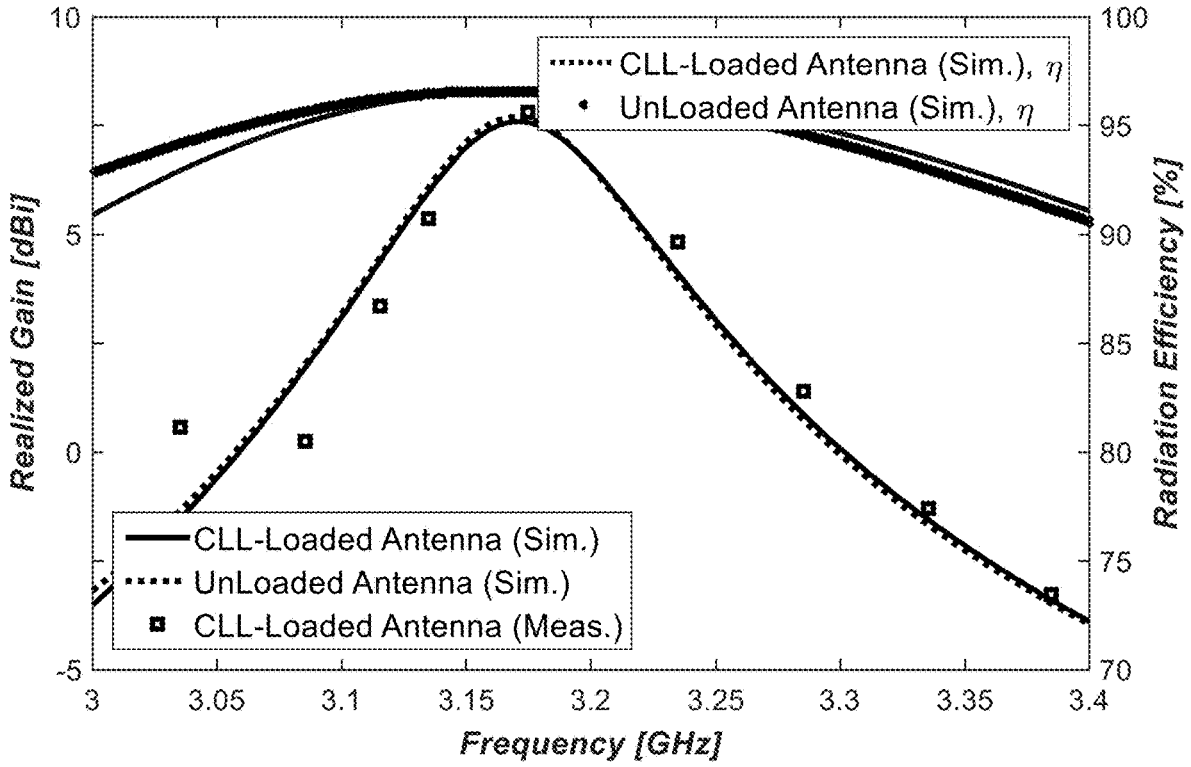
FIG. 8A shows variations of a realized gain and a radiation efficiency of an exemplary microstrip antenna versus frequency with and without MTM superstrate, consistent with one or more exemplary embodiments of the present disclosure.
Figure 8B:
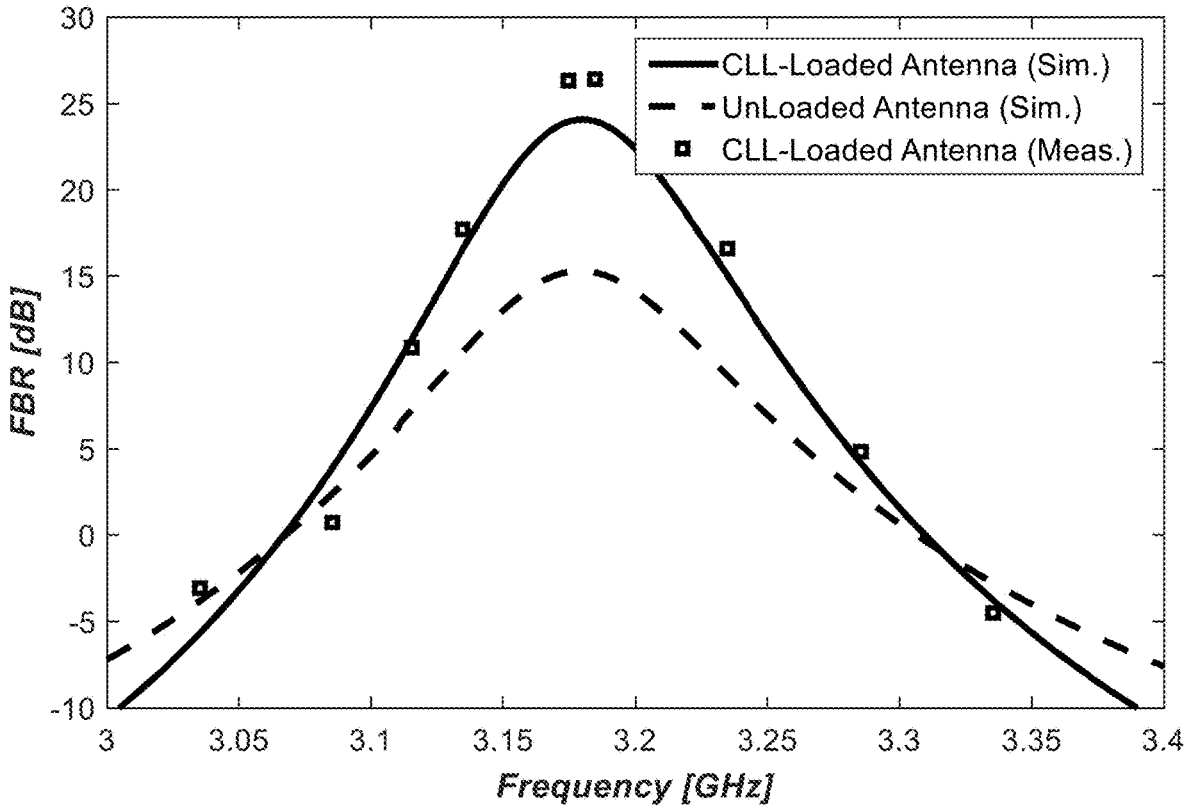
FIG. 8B shows variations of a front-to-back ratio (FBR) of an exemplary microstrip antenna versus frequency with and without MTM superstrate, consistent with one or more exemplary embodiments of the present disclosure.

FIG. 8A shows variations realized gain and a radiation efficiency of an exemplary implementation of microstrip antenna 100 versus frequency with and without MTM superstrate, consistent with one or more exemplary embodiments of the present disclosure. FIG. 8B shows variations of a front-to-back ratio (FBR) of an exemplary implementation of microstrip antenna 100 versus frequency with and without MTM superstrate, consistent with one or more exemplary embodiments of the present disclosure. The exemplary antenna has a dimension of approximately $0.60\lambda \times 0.80\lambda \times 0.14\lambda$, where $\lambda$ is the wavelength associated with the operating frequency of the antenna, and achieves a gain and an efficiency of about 7.8 dB and 95%, respectively. According to FIG. 8A, the realized gain and the radiation efficiency of the exemplary antenna does not change significantly. Simulations show that covering the antenna by using an MTM superstrate reduces the gain and the efficiency by about a 0.1 dB and about 2%, respectively. According to FIG. 8B, the simulations show that FBR is enhanced more than about 12 dB, which is in good agreement with the measured radiation pattern.

Figure 9A:
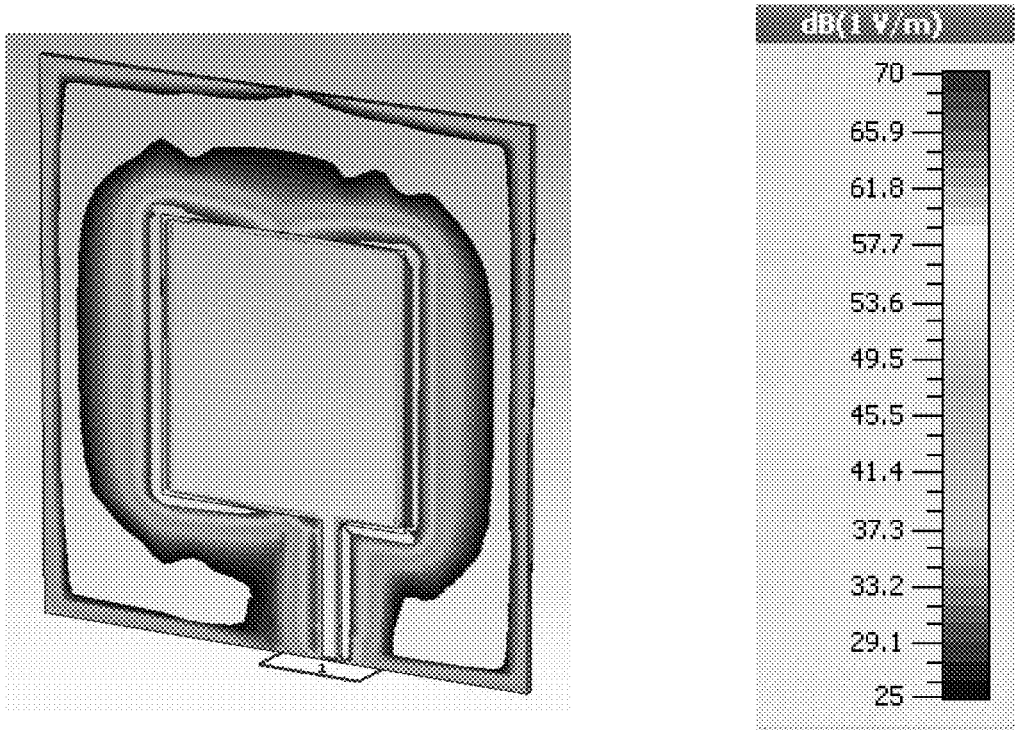
FIG. 9A shows a distribution of a tangential component of an electric field of an exemplary unloaded patch antenna, consistent with one or more exemplary embodiments of the present disclosure.
Figure 9B:
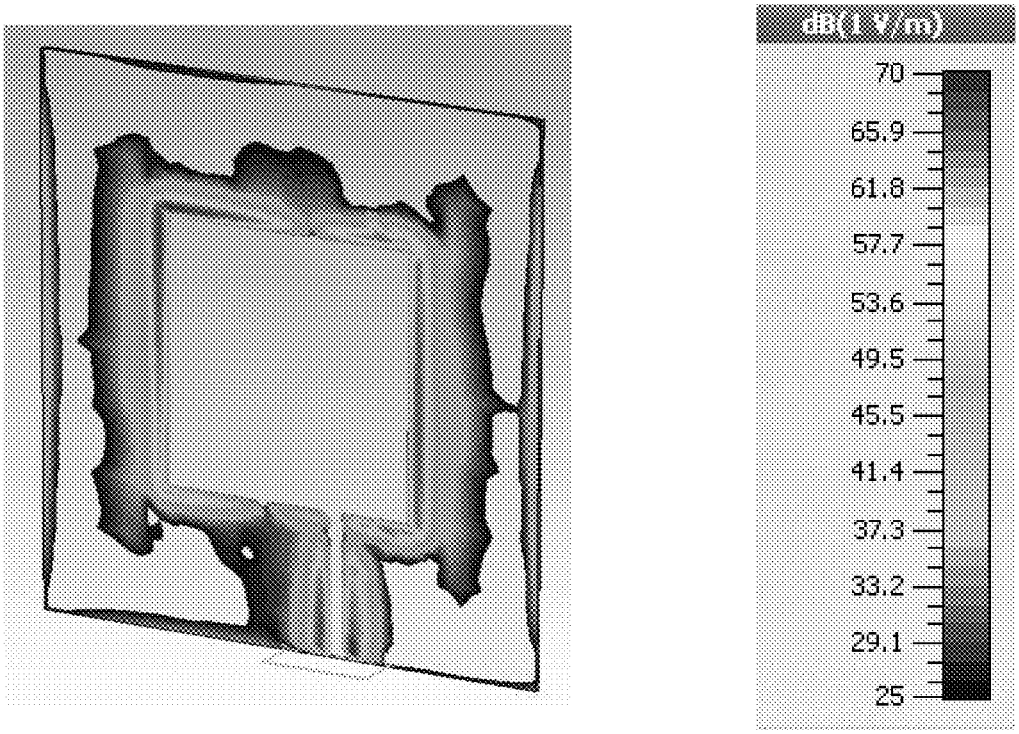
FIG. 9B shows a distribution of a tangential component of an electric field of an exemplary implementation of microstrip antenna 100, consistent with one or more exemplary embodiments of the present disclosure.

FIG. 9A shows a distribution of a tangential component of an electric field of an exemplary unloaded patch antenna, consistent with one or more exemplary embodiments of the present disclosure. FIG. 9B shows a distribution of a tangential component of an electric field of an exemplary implementation of microstrip antenna 100, that is loaded with a CLL-MTM superstrate. As shown in FIGS. 7A and 7B, the field strength at the edges of the substrate of the unloaded antenna is greater than the loaded one, further validating the surface wave suppression and back radiation reduction of CLL-MTM superstrate. Moreover, the electric field strength at the surface of the excited antenna in both cases is approximately equivalent, which leads to minimal changes in the antenna gain and directivity.

Figure 10A:
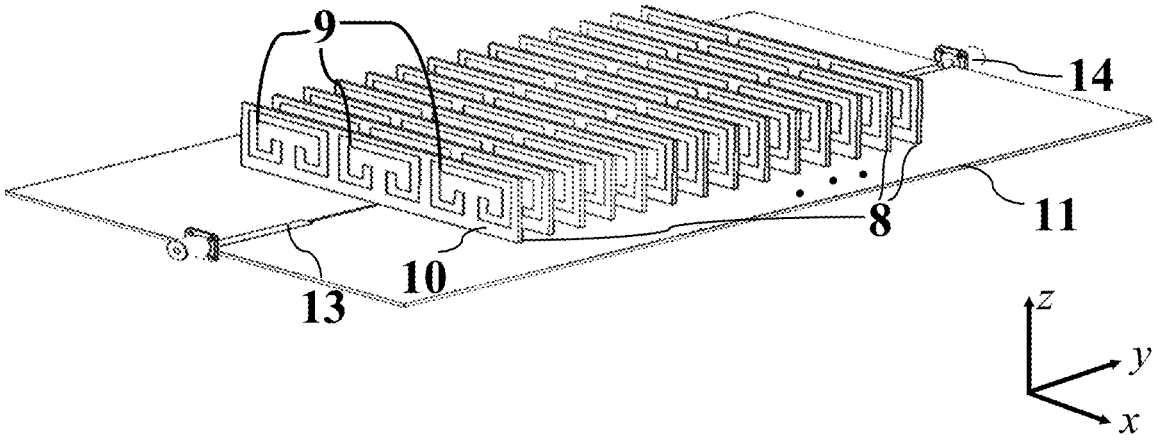
FIG. 10A shows a perspective view of an exemplary array of patch antennas with CLL-MTM superstrates, consistent with one or more exemplary embodiments of the present disclosure.
Figure 10B:
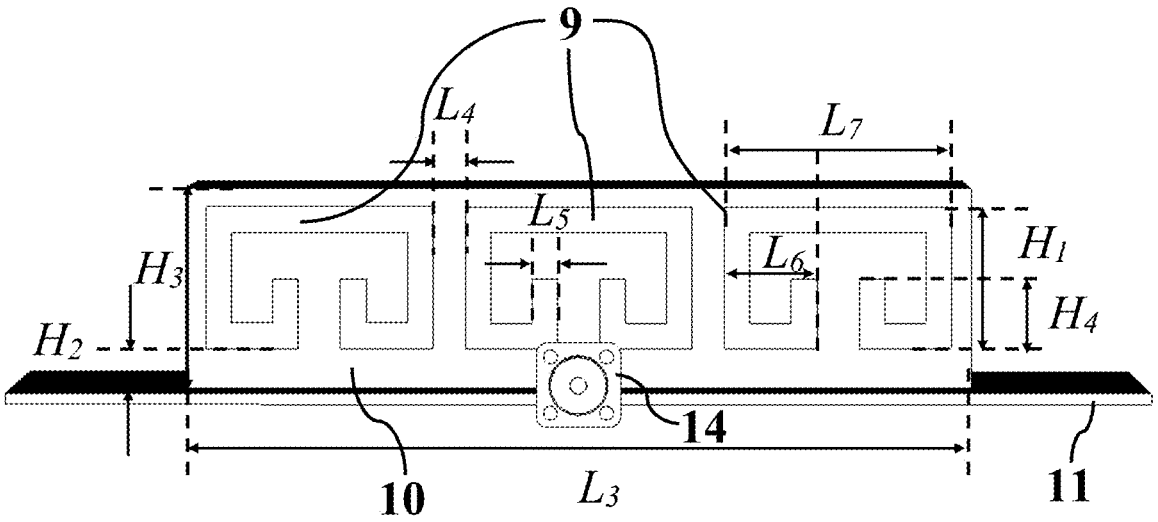
FIG. 10B shows a side view of a plurality of CLL-MTM units place on an exemplary slab, consistent with one or more exemplary embodiments of the present disclosure.
Figure 10C:
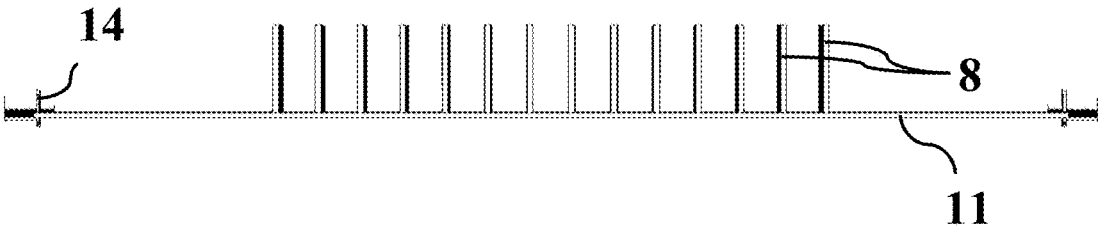
FIG. 10C shows a side view of a plurality of slabs placed on an exemplary array of patch antennas with CLL-MTM superstrates, consistent with one or more exemplary embodiments of the present disclosure.
Figure 10D:
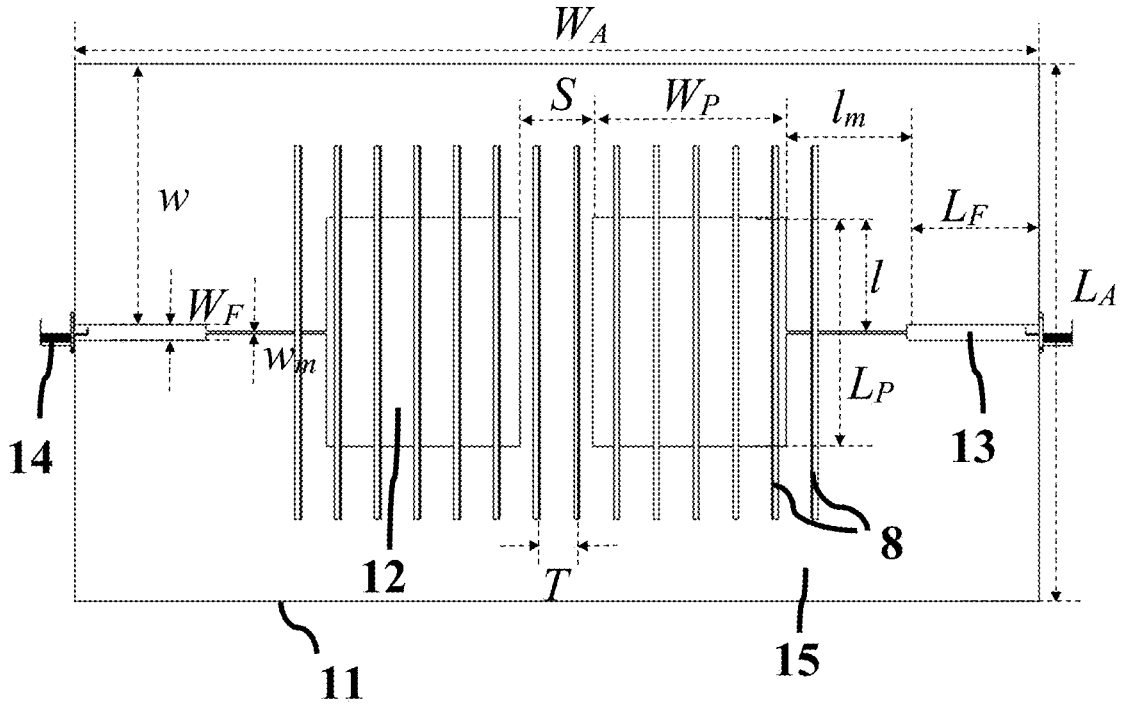
FIG. 10D shows a top view of an exemplary array of patch antennas with CLL-MTM superstrates, consistent with one or more exemplary embodiments of the present disclosure.

FIG. 10A shows a perspective view of an exemplary array of patch antennas with CLL-MTM superstrates, consistent with one or more exemplary embodiments of the present disclosure. FIG. 10B shows a side view of a plurality of CLL-MTM units place on an exemplary slab, consistent with one or more exemplary embodiments of the present disclosure. FIG. 10C shows a side view of a plurality of slabs placed on an exemplary array of patch antennas with CLL-MTM superstrates, consistent with one or more exemplary embodiments of the present disclosure. FIG. 10D shows a top view of an exemplary array of patch antennas with CLL-MTM superstrates, consistent with one or more exemplary embodiments of the present disclosure. As a direct effect of surface wave suppression capability, method 200 may be effective in array mutual coupling reduction. The CLL-MTM superstrate may be designed to work at the resonance frequency of an array antenna 11. The values of an exemplary implementation of plurality of CLL-MTM units 9 design parameters are provided in Table 3. The antennas matched to 50Ω through feed lines 13 using SMA connectors 14. The numerical simulations show that the CLL layer exhibits an effective $\varepsilon_r\mu_r$ of around 3 at about 3.32 GHz. Two element patches 12 are printed on a substrate 15 (RT-Duroid 5880) with a dielectric constant of about 2.2 and a thickness of about 0.762 mm.

Figure 11:
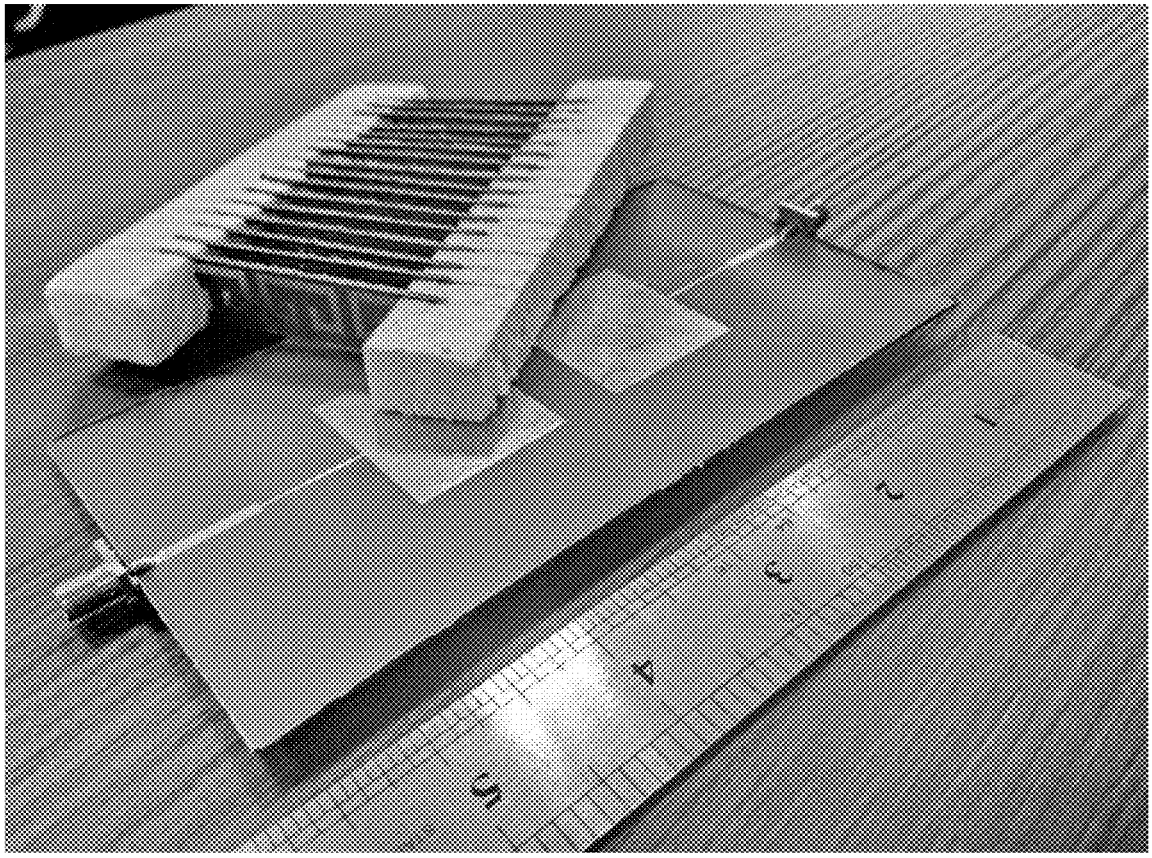
FIG. 11 shows a fabricated prototype of an array antenna, consistent with one or more exemplary embodiments of the present disclosure.

FIG. 11 shows a fabricated prototype of array antenna 11, consistent with one or more exemplary embodiments of the present disclosure. Two bulks of foam with a dielectric constant of about 1 are used to hold an array of CLL-MTM layers at an equally-spaced arrangement.

TABLE 3

The CLL-MTM loaded antenna design parameters.

| Design Parameters | Value (mm) | Design Parameters | Value (mm) |
|---|---|---|---|
| $L_A$ | 81.5 | $L_3$ | 56.4 |
| $W_A$ | 146 | $L_4$ | 2.35 |
| $L_P$ | 29.24 | $L_5$ | 1.83 |
| $W_P$ | 34.7 | $L_6$ | 6.6 |
| $W_F$ | 2.4 | $L_7$ | 16.3 |
| $L_F$ | 20 | $H_1$ | 10.18 |
| w | 39.6 | $H_2$ | 2.84 |
| $w_m$ | 0.38 | $H_3$ | 14.3 |
| l | 17.1 | $H_4$ | 5 |
| $l_m$ | 18.2 | T | 6 |
| S | 11.1 | | |

For a rectangular patch antenna 12 with the size of $L_P \times W_P$, the dominated mode is $TM_{010}$ and the electric field intensity beneath the patch varies as a cosine function in the y-axis, and is constant in the x-axis. To impose maximum uniformity and due to the anisotropic response of the CLL-MTM structure, plurality of parallel slabs 8 are placed in a way that the electric field uniformly illuminates the cells.

Figure 12A:
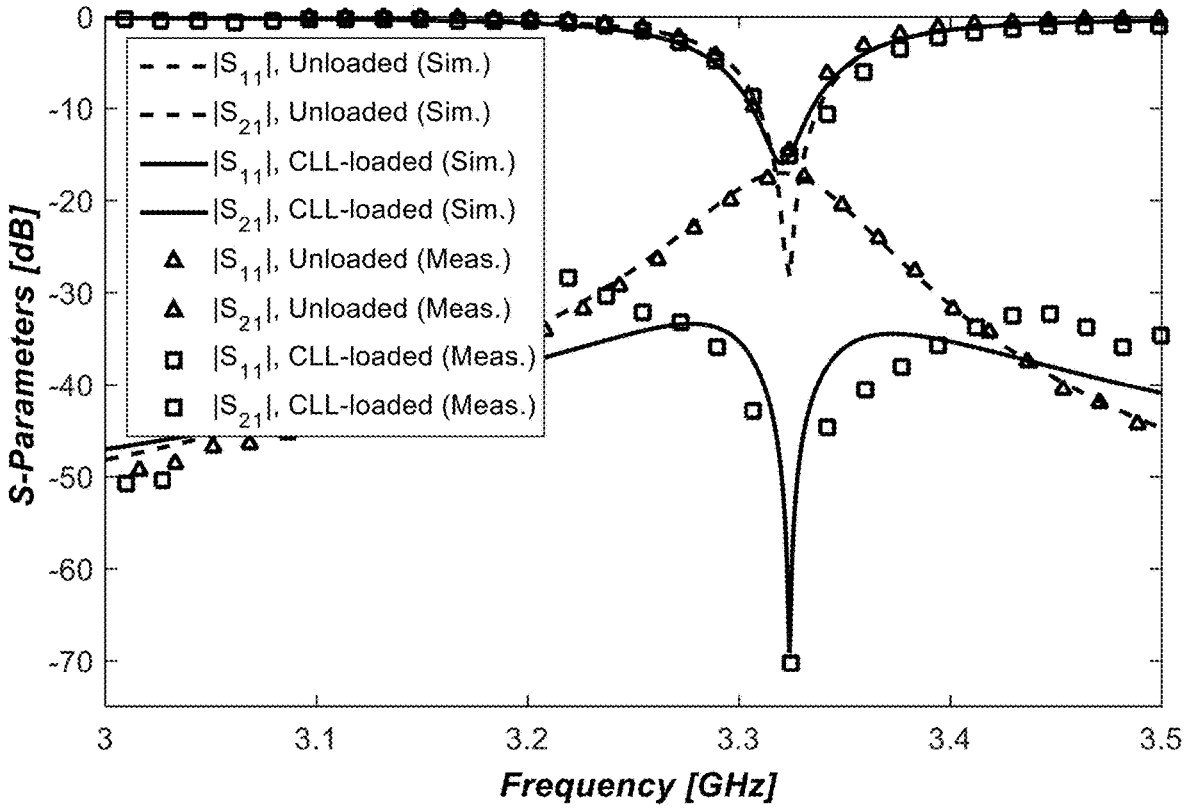
FIG. 12A shows variations of simulated and measured S-parameters of an exemplary antenna array with and without metamaterial superstrate versus frequency, consistent with one or more exemplary embodiments of the present disclosure.

FIG. 12A shows variations of simulated and measured S-parameters of an exemplary implementation of antenna array 11 with and without metamaterial superstrate versus frequency, consistent with one or more exemplary embodiments of the present disclosure. The measured and simulated reflection coefficients of array antenna 11 with and without the CLL-MTM superstrate are compared in the figure. A good agreement is observed between simulation and measurement results. The array antenna impedance bandwidth ($|S_{11}|<-10$ dB) of about 1.2% is observed from about 3.3 to about 3.34 GHz. The presence of the CLL-MTM superstrate does not have a significant effect on the array antenna matching condition. The measurement results show the mutual coupling reduction of more than about 55 dB.

Figure 12B:
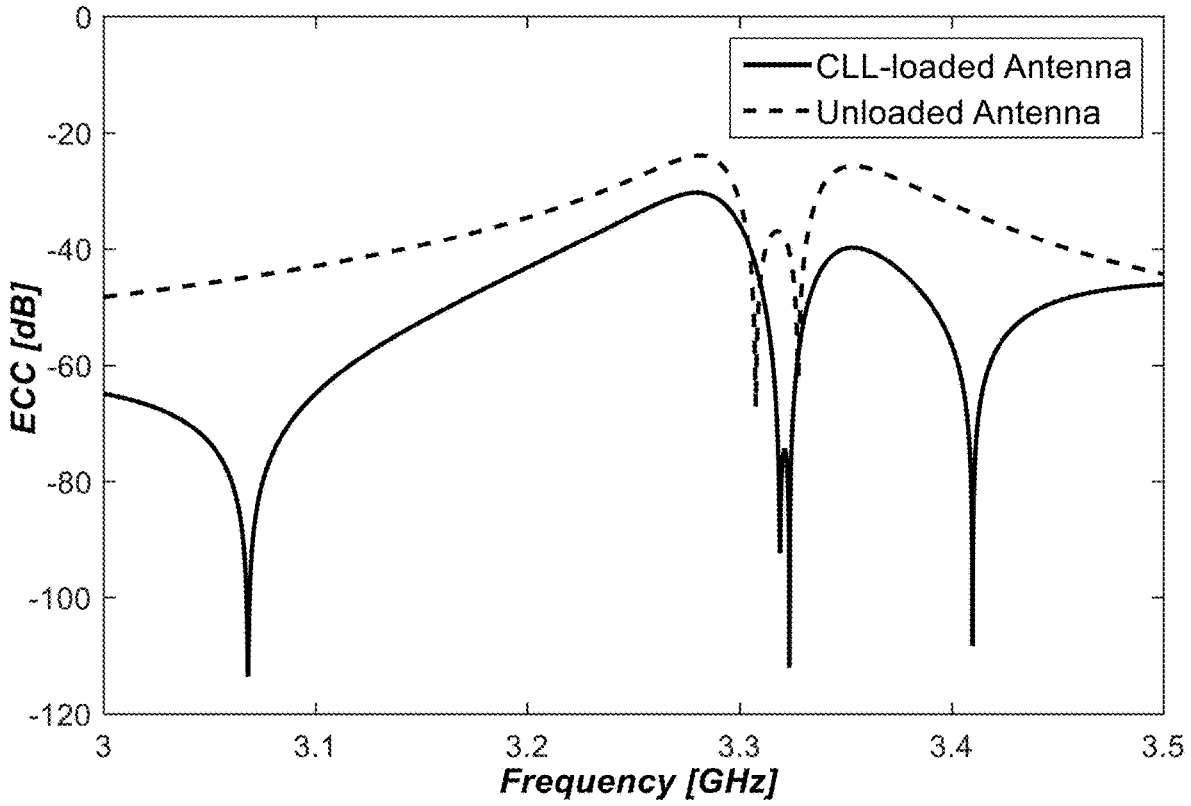
FIG. 12B show variations of simulated envelope correlation coefficient (ECC) of an exemplary antenna array with and without metamaterial superstrate versus frequency, consistent with one or more exemplary embodiments of the present disclosure.

Multiple input multiple output (MIMO) systems may be useful for improving wireless throughput. The systems may require multiple antennas spaced very closely to each other. Avoiding mutual coupling effects and simultaneously maintaining the independence of the paths is favored by larger antenna spacing, whereas practical considerations often demand compact configurations, especially in handheld/portable applications. An envelope correlation coefficient (ECC) provides the level of independence of each antenna. The radiation pattern of the antennas, their polarizations, and the relative phase of the fields between them are taken into account in evaluating the ECC. FIG. 12B shows variations of simulated ECC of an exemplary implementation of antenna array 11 with and without metamaterial superstrate versus frequency, consistent with one or more exemplary embodiments of the present disclosure. The envelope correlation coefficient decreases significantly in a case of a CLL-MTM superstrate loaded array, which is preferred for MIMO applications. The simulation shows more than about 45 dB reduction in ECC in a case of CLL-MTM loaded array antennas.

Figure 13A:
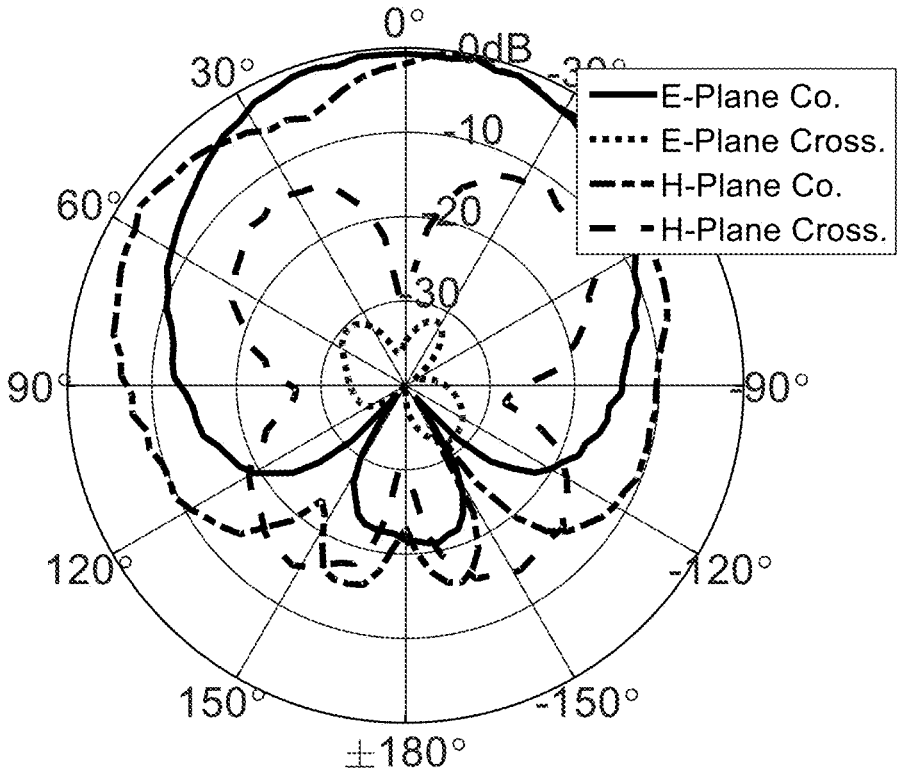
FIG. 13A shows measured normalized far-field radiation patterns of an exemplary antenna array with a CLL-MTM superstrate, consistent with one or more exemplary embodiments of the present disclosure.
Figure 13B:
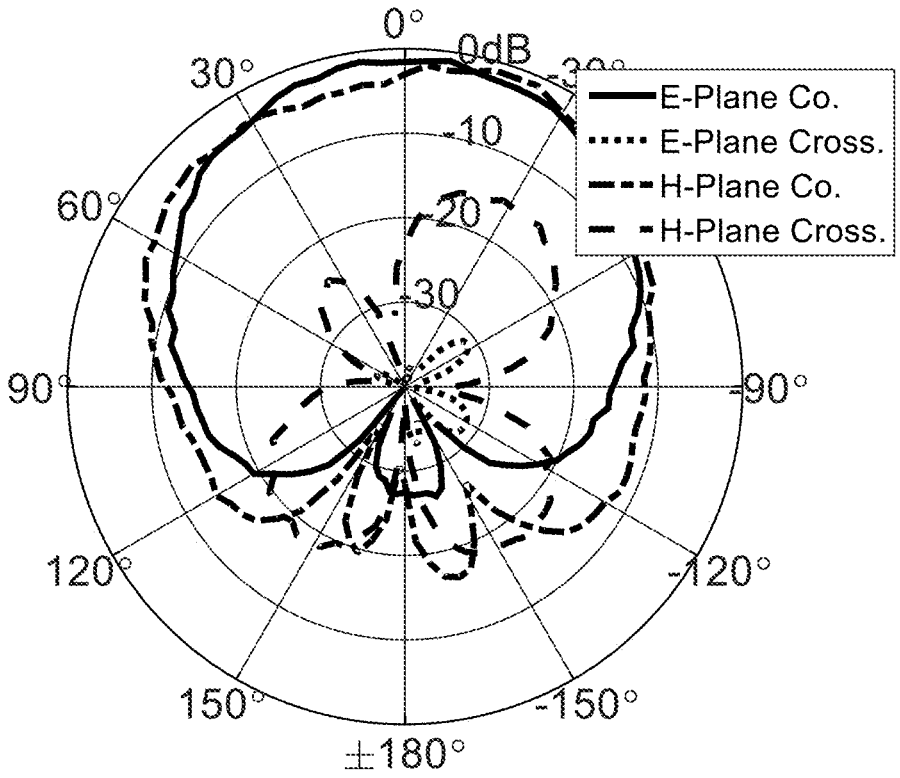
FIG. 13B shows measured normalized far-field radiation patterns of an exemplary antenna array without a CLL-MTM superstrate, consistent with one or more exemplary embodiments of the present disclosure.

FIG. 13A shows measured normalized far-field radiation patterns of an exemplary implementation of antenna array 11 with a CLL-MTM superstrate, consistent with one or more exemplary embodiments of the present disclosure. FIG. 13B shows measured normalized far-field radiation patterns of an exemplary implementation of antenna array 11 without a CLL-MTM superstrate, consistent with one or more exemplary embodiments of the present disclosure. The presence of the CLL-MTM superstrate may have minimal effect on the main lobe characteristics. The FBR of the structure is better than about 19.5 dB. Since the size of a single antenna (29.24 mm×34.7 mm) in the resonance frequency is about $0.5\lambda_g$, where $\lambda_g$ is the guided wavelength, the radiation patterns are similar to the main propagating mode of a conventional patch antenna ($TM_{10}$) in the entire impedance bandwidth.

Figure 14A:
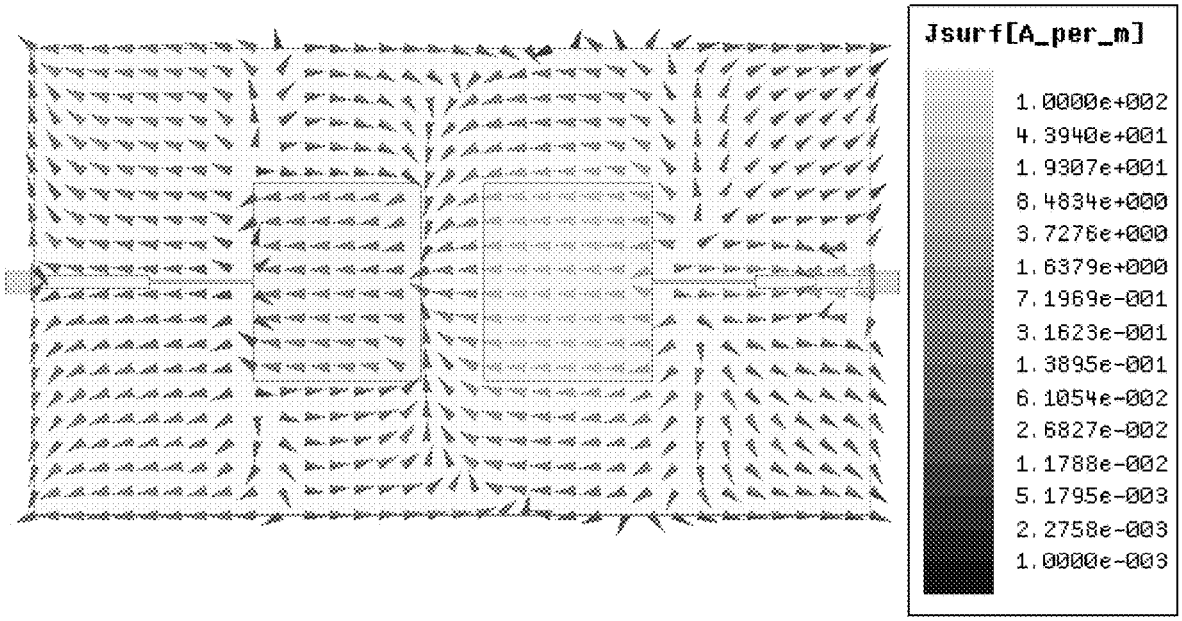
FIG. 14A shows a surface current distribution of an exemplary unloaded array antenna, consistent with one or more exemplary embodiments of the present disclosure.
Figure 14B:
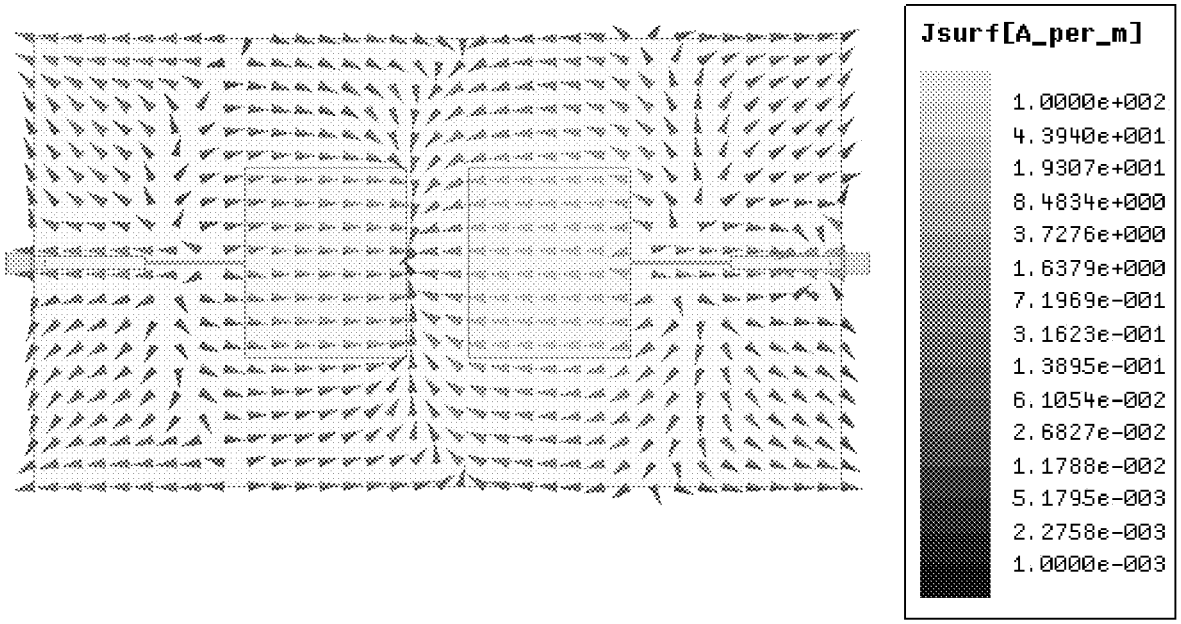
FIG. 14B shows a surface current distribution of an exemplary array antenna, consistent with one or more exemplary embodiments of the present disclosure.

FIG. 14A shows a surface current distribution of an exemplary unloaded array antenna, consistent with one or more exemplary embodiments of the present disclosure. FIG. 14B shows a surface current distribution of an exemplary implementation of array antenna 11, consistent with one or more exemplary embodiments of the present disclosure. Numerical results show that the couple surface current in the case of loaded array antenna 11 is more than about 40 dB lower than the loaded one. Consequently, reduction of the coupled surface current increases the isolation between the antenna elements. Moreover, the direction of the coupled surface current of the CLL-MTM superstrate in the left side patch is changed.

Figure 15:
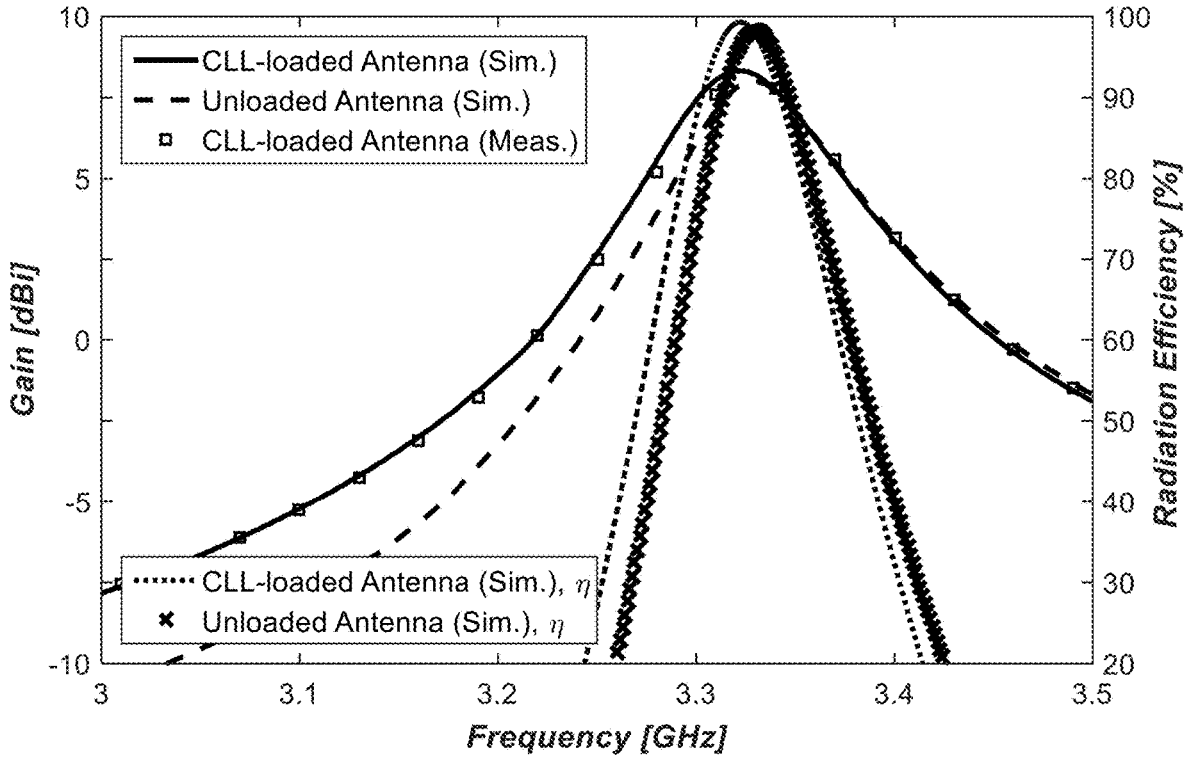
FIG. 15 shows gain and efficiency variations of exemplary array antennas with and without a CLL-MTM superstrate versus frequency, consistent with one or more exemplary embodiments of the present disclosure.

FIG. 15 shows gain and efficiency variations of exemplary array antennas with and without a CLL-MTM superstrate versus frequency, consistent with one or more exemplary embodiments of the present disclosure. Array antenna 11 has an overall dimension of approximately $1.6\lambda_0 \times 0.9\lambda_0 \times 0.16\lambda_0$, where $\lambda_0$ is the free space wavelength, and achieves a realized gain and a radiation efficiency of about 8.2 dB and 97%, respectively. According to FIG. 15, the measured realized gain and simulated radiation efficiency of the antenna does not change significantly. Simulations show that covering array antenna 11 by the CLL-MTM superstrate causes gain and efficiency enhancement of more than about 0.1 dB and 2%, respectively. Measurement shows good agreement with the numerical results.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102 or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for reducing mutual coupling and back-lobe radiation of a microstrip antenna, the method comprising:

printing a metal patch of a microstrip antenna on a dielectric substrate with a first relative permittivity; and placing a magneto-dielectric superstrate comprising a superstrate with a second relative permittivity and a relative permeability above the metal patch, the second relative permittivity and the relative permeability satisfying a condition according to the following:

$$|\varepsilon_1-\varepsilon_2\cdot\mu_2|<0.5,$$

where $\varepsilon_1$ is a value of the first relative permittivity, $\varepsilon_2$ is a value of the second relative permittivity, and $\mu_2$ is a value of the relative permeability.

2. The method of claim 1, wherein placing the magneto-dielectric superstrate above the metal patch comprises placing a plurality of parallel slabs with an effective relative permittivity and an effective relative permeability above the metal patch, each of the plurality of parallel slabs comprising a plurality of capacitively loaded loop metamaterial (CLL-MTM) units.

3. The method of claim 2, further comprising generating an electric field in the metal patch through a feed line, the electric field parallel with planes of the plurality of parallel slabs.

4. The method of claim 2, wherein placing the plurality of parallel slabs above the metal patch comprises providing a space between two successive parallel slabs of the plurality of parallel slabs, the space satisfying a condition according to the following:

$$(N-1)\times T\leq W_A,$$

where N is the number of the plurality of parallel slabs, T is the space, and $W_A$ is a width of the dielectric substrate.

5. The method of claim 2, wherein placing the plurality of parallel slabs above the metal patch comprises placing a plurality of equally-spaced parallel slabs above the metal patch, a length of each of the plurality of equally-spaced parallel slabs equal to or smaller than a length of the dielectric substrate.

6. The method of claim 1, wherein placing the magneto-dielectric superstrate above the metal patch comprises placing the magneto-dielectric superstrate on an air gap above the metal patch, a height of the airgap smaller than ten percent of a wavelength associated with an operating frequency of the microstrip antenna.

7. A microstrip antenna with reduced mutual coupling and back-lobe radiation, comprising:

a dielectric substrate with a first relative permittivity;

a metal patch printed on the dielectric substrate; and a magneto-dielectric superstrate placed above the metal patch, the magneto-dielectric superstrate comprising a superstrate with a second relative permittivity and a relative permeability, the second relative permittivity and the relative permeability satisfying a condition according to the following:

$$|\varepsilon_1-\varepsilon_2\cdot\mu_2|<0.5$$

where $\varepsilon_1$ is a value of the first relative permittivity, $\varepsilon_2$ is a value of the second relative permittivity, and $\mu_2$ is a value of the relative permeability.

8. The microstrip antenna of claim 7, wherein the magneto-dielectric superstrate comprises a plurality of parallel slabs.

9. The microstrip antenna of claim 8, further comprising a feed line configured to generate an electric field in the metal patch, the electric field parallel with planes of the plurality of parallel slabs.

10. The microstrip antenna of claim 8, further comprising a space between each two successive parallel slabs of the plurality of parallel slabs, the space satisfying a condition according to the following:

$$(N-1)\times T\leq W_A,$$

where N is the number of the plurality of parallel slabs, T is the space, and $W_A$ is a width of the dielectric substrate.

11. The microstrip antenna of claim 8, wherein the plurality of parallel slabs comprise a plurality of equally-spaced parallel slabs.

12. The microstrip antenna of claim 7, wherein the magneto-dielectric superstrate is placed on an air gap above the metal patch.

13. The microstrip antenna of claim 12, wherein a height of the air gap is smaller than ten percent of a wavelength associated with an operating frequency of the microstrip antenna.

14. The microstrip antenna of claim 11, wherein a length of each of the plurality of equally-spaced parallel slabs is equal to or smaller than a length of the dielectric substrate.

15. The microstrip antenna of claim 8, wherein each of the plurality of parallel slabs comprises a plurality of capacitively loaded loop metamaterial (CLL-MTM) units.

16. An array of microstrip antennas with reduced mutual coupling and back-lobe radiation, each microstrip antenna of the array of microstrip antennas comprising:

a dielectric substrate with a relative permittivity;

a metal patch printed on the dielectric substrate;

a magneto-dielectric superstrate placed above the metal patch, the magneto-dielectric superstrate comprising a metamaterial (MTM) superstrate with an effective relative permittivity and an effective relative permeability, the MTM superstrate comprising a plurality of equally-spaced parallel slabs, each of the plurality of equally-spaced parallel slabs comprising a plurality of capacitively loaded loop metamaterial (CLL-MTM) units; and a feed line configured to generate an electric field in the metal patch, the electric field parallel with planes of the plurality of equally-spaced parallel slabs;

wherein the effective relative permittivity and the effective relative permeability satisfy a condition according to the following:

$$|\varepsilon_1-\varepsilon_2\cdot\mu 2|<0.5$$

where $\varepsilon_1$ is a value of the relative permittivity, $\varepsilon_2$ is a value of the effective relative permittivity, and $\mu_2$ is a value of the effective relative permeability.

17. The array of claim 16, wherein a space between each two successive equally-spaced parallel slabs of the plurality of equally-spaced parallel slabs satisfies a condition according to the following:

$$(N-1)\times T\leq W_A$$

where N is the number of the plurality of equally-spaced parallel slabs, T is the space, and $W_A$ is a width of the dielectric substrate.

18. The array of claim 16, wherein a length of each of the plurality of equally-spaced parallel slabs is equal to or smaller than a length of the dielectric substrate.

19. The array of claim 16, wherein the magneto-dielectric superstrate is placed on an air gap above the metal patch.

20. The array of claim 19, wherein, a height of the air gap is smaller than ten percent of a wavelength associated with an operating frequency of the array of microstrip antennas.

* * * * *